US008291924B2

(12) United States Patent
King et al.

(10) Patent No.: US 8,291,924 B2
(45) Date of Patent: Oct. 23, 2012

(54) MULTI-CONFIGURATION WALKING APPARATUS

(75) Inventors: Dannie H. King, Carlsbad, CA (US); Nicholas Allen King, Carlsbad, CA (US)

(73) Assignee: Songline Mobility, Inc., Carlsbad, CA (US)

( * ) Notice: Subject to any disclaimer, the term of this patent is extended or adjusted under 35 U.S.C. 154(b) by 0 days.

(21) Appl. No.: 12/817,073

(22) Filed: Jun. 16, 2010

(65) Prior Publication Data

US 2010/0313923 A1 Dec. 16, 2010

Related U.S. Application Data

(60) Provisional application No. 61/187,274, filed on Jun. 16, 2009.

(51) Int. Cl.
*A45B 9/00* (2006.01)

(52) U.S. Cl. ..... 135/65; 135/66

(58) Field of Classification Search ..... 135/65, 135/66, 67, 74, 75; 248/155, 155.4
See application file for complete search history.

(56) References Cited

U.S. PATENT DOCUMENTS

| | | | | | |
|---|---|---|---|---|---|
| 432,759 | A | * | 7/1890 | Minniss | 135/66 |
| 2,159,301 | A | | 5/1939 | Upton | |
| 2,518,763 | A | | 8/1950 | Du Bois | |
| 2,667,914 | A | | 2/1954 | Forbes | |
| 2,734,554 | A | * | 2/1956 | Ries | 482/66 |
| 2,812,950 | A | * | 11/1957 | Holloway | 280/42 |
| 2,932,526 | A | * | 4/1960 | Campbell | 280/42 |
| 2,960,148 | A | | 11/1960 | Murcott | |
| 3,421,529 | A | | 1/1969 | Vestal | |
| 3,716,067 | A | * | 2/1973 | Skoog | 135/67 |
| 3,993,088 | A | | 11/1976 | Thomas | |
| 4,106,521 | A | | 8/1978 | Thomas | |
| 4,245,659 | A | * | 1/1981 | Shofner | 135/68 |
| 4,456,284 | A | * | 6/1984 | Saka | 280/812 |
| D291,791 | S | | 9/1987 | Bean | |
| 4,962,781 | A | * | 10/1990 | Kanbar | 135/65 |
| 4,995,412 | A | | 2/1991 | Hirn | |
| 5,069,446 | A | | 12/1991 | Larson | |
| 5,113,887 | A | | 5/1992 | Herman, Jr. | |
| 5,217,419 | A | | 6/1993 | Harwood | |
| 5,349,977 | A | | 9/1994 | Wood | |

(Continued)

OTHER PUBLICATIONS

International Search Report dated Sep. 16, 2011, for International Patent Application No. PCT/US2010/059741, filed Dec. 9, 2010.

*Primary Examiner* — Noah Chandler Hawk
(74) *Attorney, Agent, or Firm* — Knobbe Martens Olson & Bear LLP

(57) ABSTRACT

A multifunctional mobility device which enables or assists a person to walk without assistance from another person. The device provides a practical solution to address the various levels of mobility assistance between the minimal support of a cane and the maximum support of a four-legged walker. The multiple functions of the device are enabled by changing width and height, and include a one-legged, two-handed walker; a two-legged, two-handed walker; a hemi-walker; a stair-climbing aide; a standard or bariatric cane; and a device providing assistance from the sitting to standing position. The device may employ a jointed handle of sufficient width to accommodate both hands, and two legs connected to the handle that move inward or outward in unison, using the jointed handle and a compound, articulating mechanism connecting the two legs.

10 Claims, 8 Drawing Sheets

U.S. PATENT DOCUMENTS

| | | | | | |
|---|---|---|---|---|---|
| 5,495,867 | A | | 3/1996 | Block | |
| 5,499,645 | A | | 3/1996 | Baliga | |
| 5,499,856 | A | * | 3/1996 | Sorrell et al. | 297/5 |
| 5,575,299 | A | | 11/1996 | Bieri | |
| 5,603,517 | A | | 2/1997 | Lorman | |
| 5,640,986 | A | | 6/1997 | Herman | |
| 5,673,719 | A | | 10/1997 | Shofner | |
| 5,676,388 | A | | 10/1997 | Bertani | |
| 5,785,070 | A | | 7/1998 | Block et al. | |
| 5,806,548 | A | | 9/1998 | Goldstein | |
| 5,862,824 | A | | 1/1999 | Herman | |
| 5,904,167 | A | | 5/1999 | Moye | |
| 5,979,476 | A | | 11/1999 | Cranny | |
| 6,206,019 | B1 | | 3/2001 | Horvits | |
| 6,217,056 | B1 | * | 4/2001 | Tsuchie | 280/639 |
| 6,755,203 | B1 | | 6/2004 | Roeglin | |
| 7,377,285 | B2 | | 4/2005 | Karasin | |
| 7,229,092 | B1 | | 6/2007 | Parker | |
| 2004/0118442 | A1 | * | 6/2004 | Roeglin | 135/67 |
| 2007/0163633 | A1 | * | 7/2007 | Gale | 135/67 |
| 2008/0029138 | A1 | * | 2/2008 | Foote | 135/67 |
| 2010/0313923 | A1 | | 12/2010 | King et al. | |
| 2011/0030749 | A1 | * | 2/2011 | Miller | 135/67 |

* cited by examiner

MULTI-CONFIGURATION WALKING APPARATUS

RELATED APPLICATIONS

This application is claims the benefit of U.S. Provisional Application No. 61/187,274, filed on Jun. 16, 2009.

BACKGROUND

1. Field

The present invention relates generally to the field of walkers, walking canes or other apparatuses to facilitate the free movement of individuals and, more particularly, to a cane/walker hybrid capable of addressing various levels of mobility assistance.

2. Description of Related Art

Most people think of mobility aids as walking support, but they may also serve to facilitate less important roles by assisting people in getting in and out of bed, transitioning to or from a sitting position, and becoming generally more mobile.

Standing and taking a normal stride provide important benefits to the body. They help breathing efficiency, maintain muscle tone, increase the production of antibodies that fight infection, reduce loss of calcium in bones, and allow food to pass through the digestive system more properly and easily than when a person is if confined to the bed or impeded by a walker.

Unfortunately, mobility devices have a stigma associated with their use. Often people experience embarrassment and frustration or become upset if required to use these devices. Mobility aids often signal a loss of function and dignity as well. However these aids can help one gain their previous abilities or slow their deterioration. They additionally help in reducing pain associated with movement. Walking aids also alert others to be patient and careful around people who use them. Canes, walkers, and wheel chairs are tools that help people become mobile and live a more full life.

Older people and those with arthritis, leg or foot injuries, balance problems, strokes and degenerative diseases like multiple sclerosis can benefit greatly from the balance and support of a cane or walker. Unfortunately, fear of losing independence or appearing disabled prevents many from using a cane or walker. People instead prefer holding onto furniture or their spouse to get around. But, such actions are actually signs that a walking aid is needed.

Typically, a user progresses from one mobility aid to another as strength and abilities change. Standard canes are the easiest to handle and least cumbersome of all mobility aids. They can support about 25 percent of a person's weight whereas walkers support about 50 percent. Single point canes are the least restrictive and work best for people with minor injuries or balance problems but who can support most of their own weight. Many styles of canes are available, including collapsible models. The cane adequately allows the patient to achieve balance, but should not be used for weight bearing. For patients suffering from a more serious balance deficit, a quad cane (one with four small legs) may be used. Most people do not understand the function of a cane and therefore do not actually receive benefit from its use. A cane with an offset handle is the most stable type of cane. The weight of the user is placed directly over the cane base, allowing greater control.

Quad canes have four "feet" configured in either a narrow-base or wide-base, and offer greater stability to those with more serious balance issues but no major weight-bearing problems.

Recommended cane use is typically illustrated by a user holding a cane on the stronger side of the body to reduce the amount of weight placed on the weak or injured side, thus providing better overall balance. The user places all of their weight on the unaffected leg and simultaneously moves the cane and the weaker leg forward. The cane supports the walker leg while the user steps forward with the stronger leg. The heel of the stronger foot should be placed a little beyond the tip of the cane. The cane should be placed firmly on the ground with each step, being careful to not place it too far ahead, as this may result in slipping of the cane.

Canes serve an important function as a mobility device, but their function is limited by the narrow spectrum of their suitable uses. Canes are adequate for the individuals who are uncomfortable walking without some type of assistance. Additionally, canes also provide minimal support to the user. The simple design of a cane provides users with an inconspicuous device that offers dignity and character to an individual without calling great attention to a person's aliments or physical needs. As the need for greater stability increases, the individual loses confidence in the cane and moves to the next level of assistance in walking.

Walkers are the next level of support for the mobility impaired and are a major transition. There are many challenges, both physically and psychologically, in transitioning from a cane to a four-legged walker. While the cane may be required as an addition to ones normal walking activity, in some cultures a cane is a symbol of stateliness and is not necessarily viewed as a medical device. In contrast, patients frequently do not willingly transition to a walker, as it "announces" one's physical disability. This reluctance leads to estimates that roughly 60% of elderly persons needing assistance refuse to use a cane or walker because of the stigma associated with such device.

Walkers are stable mobility devices which can help patients who have significant balance deficits that are too severe for a cane. Having four legs, the walker offers a relatively light weight, stable device. Walkers come in two basic variations, standard and roller. Standard walkers are lightweight frame devices having handles and four rubber-tipped feet. As patients increase their weight-bearing status, they may "graduate" to a rolling walker, which continues to offer balance and moderate weight-bearing assistance. Roller walkers are similar to standard walkers, but usually have wheels in place of some or all of the feet. They're best for those who can bear weight but need more help with balance than a cane provides. Walkers demand the least coordination.

Utilizing a walker requires a different technique than that used with a cane. The user places or rolls the walker to a position a step's length ahead of them, taking care not to place the walker too far ahead to prevent slippage. The user then leans slightly forward, holding the arms of the walker for support, and takes a step forward. It is important that the user is careful to not step too close to the walker or they may lose their balance. Additionally, all manufacturers discourage users from using the walkers on stairs due to the bulk and cumbersome qualities associated with them.

Adoption and use of a four-legged walker is attended by major adjustments and drawbacks to a user. The cumbersome nature of the device is well known and very restrictive to those who must use them. The dimensions of a four-legged walker are the main reason that walkers are uncomfortable and unwieldy. In order to achieve greater stability for a user, the four-legged walker must contact the ground at multiple points, this requirement limits use of four-legged walkers on uneven ground. As the distance between the legs increases, so does the degree of provided stability. The "Footprint" of the walker-assisted individual compared to an unassisted individual is increased nearly 3-fold, making turning and negotiating obstacles difficult. A walker takes up about the same space as a typical dining chair. Maneuvering around normally placed furniture is often impossible.

Movies glamorize cane use as a symbol of class and elegance, but society labels persons using canes and other medical devices, such as walkers, as infirm or disabled. These labels and the large degree of difference between cane and walker use prevent people from making the transition from cane to walker despite that transition being in the best interest of the person. For this reason, many people who would benefit forgo use of such devices.

Presently there is a lack of mobility-assistive devices that can fulfill the continuum of gradually increasing or decreasing needs for walking assistance. For individuals in this category, support provided by a cane is inadequate and the level of support provided by a walker is unnecessary.

SUMMARY

The methods and devices of the invention each have several aspects, no single one of which is solely responsible for its desirable attributes. Without limiting the scope of this invention, its more prominent features will now be discussed briefly. After considering this discussion, and particularly after reading the section entitled "Detailed Description of Certain Embodiments" one will understand how the features of this invention provide advantages over other walking assistance devices.

In one aspect, a walking assistance device includes, for example, a first leg, having a vertical portion with a bottom and a top, and a horizontal portion. In some embodiments, the horizontal portion has a first end distant from the vertical portion. In another aspect, a walking assistance device includes, for example, a second leg, having a vertical portion with a bottom and a top, and a horizontal portion. In some embodiments, the horizontal portion has a first end distant from the vertical portion. In some embodiments, the first ends of the horizontal portions of the first and second legs are joined together. In some embodiments, the bottom ends of the vertical portions of the first and second legs are spaced apart by an adjustable distance. In some embodiments, the adjustable distance includes a first position and a second position, where the distance between the bottom ends of the first and second legs in the second position is more that twice the distance between said bottom ends in the first position.

The walking device may include a first leg and a second leg each having a height. In some embodiments, the height of the first leg is adjustable independently of the height of the second leg, such that one said leg can be adjusted to allow traverse of uneven ground while maintaining the horizontal portions of the first and second legs in a substantially horizontal position.

The walking device may include a connecting mechanism linking the first leg and the second leg. In some embodiments, the connecting mechanism permits infinitely-variable distance adjustment between the bottom ends of the first and second legs. In some embodiments, the connecting mechanism further includes a locking structure to securely lock the relative positions of the first and second legs.

The adjustment mechanism may further include at least one strut adjustably linking the first leg and the second leg.

In another aspect, a method of using a walking assistance device includes, providing a walking assistance device, reducing the height of the first leg prior to using the device for ascending a set of stairs, reducing the height of the second leg prior using the device for descending a set of stairs, and adjusting the distance between the bottom ends of the first and second legs from a relatively wide spacing to a relatively narrow spacing.

A method for using a walking assistance device may further include grasping the walking apparatus with one hand.

A method for using a walking assistance device may further include grasping the walking apparatus with two hands.

In another aspect, a method of using a walking assistance device includes, providing a walking assistance device, and progressively reconfiguring the device to match the immediate walking assistance needs of the user by adjusting the distance between the bottom ends of the first and second legs between a relatively wide spacing and a relatively narrow spacing.

A method for using a walking assistance device may further include, grasping the device with one hand when a lesser degree of support is desired, and grasping the device with two hands when a greater degree of support is desired.

In another aspect, a multi-configuration walking apparatus includes, for example, a first leg section and a second leg section. In some embodiments, each leg section has a top and a bottom, wherein the bottom is configured for placement on the ground and the top is vertically displaced from the bottom. In some embodiments, the first and second leg sections are adjustably positionable relative to each other at two or more non-vertical distances.

In another aspect, each leg section further includes, for example, an upper leg located at the top of the leg section and a first and a second lower leg section each upper leg including a top and a bottom relative to the top and bottom of the first and second leg sections. In some embodiments, the top of the upper leg may include a handgrip section. In some embodiments, the first lower leg section is adjustably connected to the bottom of the first upper leg and is configured for variable vertical displacement relative to the bottom of the first upper leg. In some embodiments, the second lower leg section is adjustably connected to the bottom of the second upper leg and is configured for variable vertical displacement relative to the bottom of the second upper leg. In some embodiments, the non-vertical distance between the bottom of the first and second lower leg sections defines a footprint. In some embodiments, the footprint size varies according to the relative position of the first and second leg sections.

In some embodiments of a walking apparatus, the top of the upper leg of the first leg section is joined to the top of the upper leg of the second leg section.

The walking apparatus may further include at least one strut interconnecting the first and second leg sections. In some embodiments, the relative position of the first and second leg sections is adjusted by the at least one strut.

In some embodiments of the walking apparatus, the relative position of the first and second leg sections is adjusted by three struts.

In some embodiments of the walking apparatus, the struts are dimensioned to allow a desired range of footprint sizes.

The walking apparatus may further include one or more slides connected to the at least one strut and to the walking apparatus by two or more moveable joints.

The walking apparatus may further include gripping areas located on the walking apparatus, wherein the one or more gripping areas of the walking apparatus are covered.

In some embodiments, the one or more gripping areas are covered by one or more of plastic, vinyl, neoprene, or rubber.

In some embodiments of a walking apparatus, the leg sections are sized to accommodate use by persons of various sizes and weights.

In some embodiments of a walking apparatus, the leg sections may be made of aluminum tubing, ceramics, composites, or metal.

In some embodiments of a walking apparatus, the handgrip section may be made of a different material than other portions of the leg section.

DETAILED DESCRIPTION OF THE INVENTION

Figure 1:
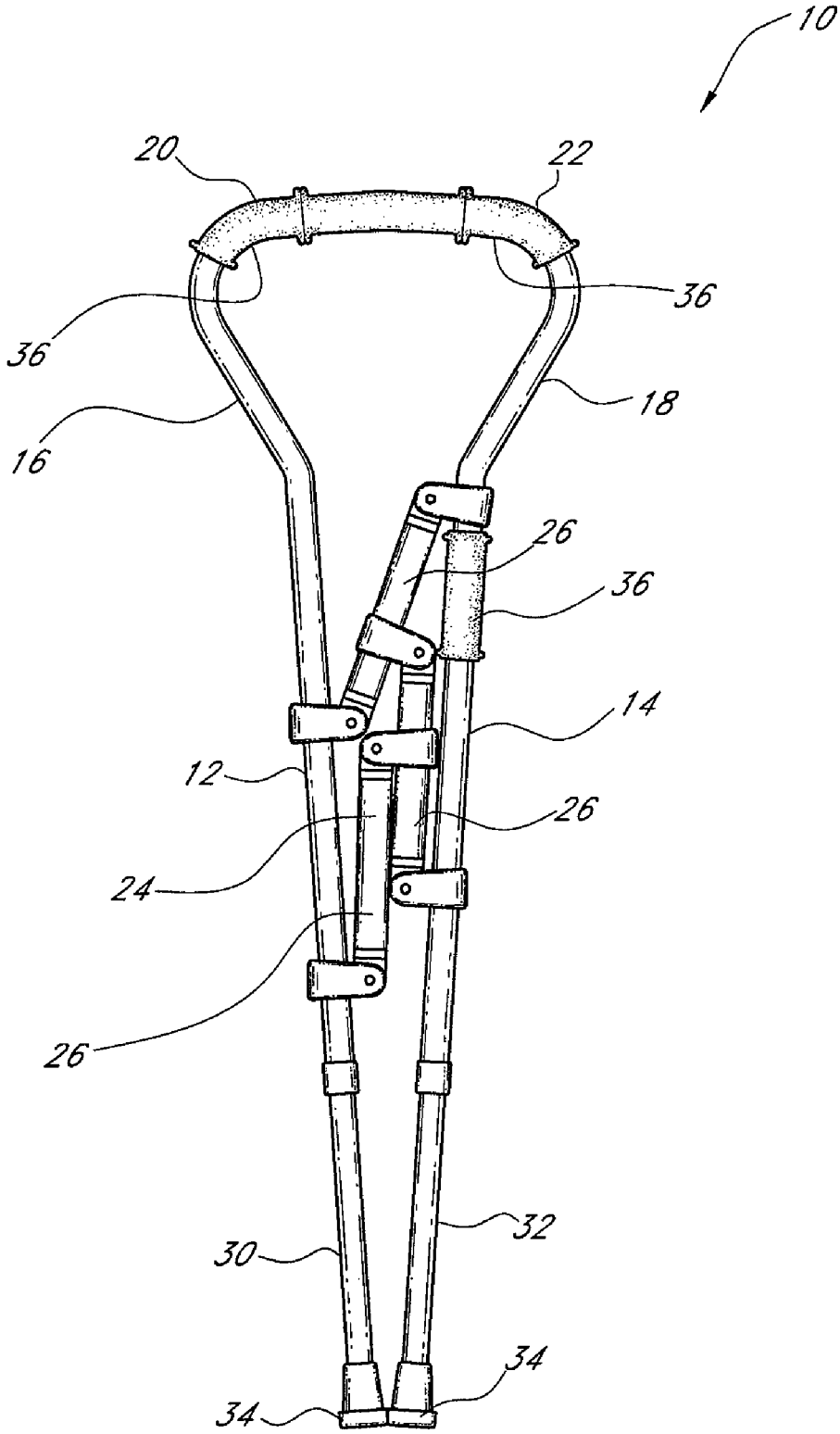
FIG. 1 is a side view of a multi-configuration walking apparatus in a closed position.

The following description and examples illustrate preferred embodiments of the present invention in detail. Those of skill in the art will recognize that there are numerous variations and modifications of this invention that are encompassed by its scope. Accordingly, the description of a preferred embodiment should not be deemed to limit the scope of the present invention. In this description, reference is made to the drawings wherein like parts are designated with like numerals throughout.

Canes and Walkers dominate the choices with regard to ambulatory devices which enable individuals to walk upright. A gap exists in the range of devices available for mobility assistance. Canes provide minimal support, but are adequate for an individual uncomfortable walking without some assistance. Manufacturers have modified the cane by adding multiple feet and, changing the grip or the shape of the unit in an attempt to make the unit more stable or safe. However, the design remains fixed on a one handed apparatus that only provides downward support, and fails to be convertible for multiple types of use.

As the need for greater stability increases, an individual loses confidence in the cane and requires lateral and forward/backward support. The remaining choice for non-wheelchair movement assistance is the four-legged walker. In many cases, the four-legged walker provides much more support than is really needed. In a great many cases, individuals using these devices unnecessarily sacrifice proper posture, balance and maneuverability. Furthermore, these devices contribute to decreased large muscle strength, diminished ability to walk on uneven surfaces, loss of mobility, and loss of ability to climb steps or stairs. Current designs fail to enable use of a single apparatus throughout the stages of care, a range spanning from the need for minimal assistance to the need for major support. The present disclosure addresses this gap with devices providing a range of support and utility to device users.

The device of the present disclosure provides unique capabilities in its different configurations. In a closed position, the device functions as a one-legged, two hander walker ideal for crossing uneven terrain and maintaining maneuverability. In a closed position, the device can further function as a bariatric cane capable of supporting up to five hundred pounds. Widening the stance provides a two-legged, two-handed configuration that increases lateral stability. In a mid-wide position, the device can be used as a hemi-walker. Multiple devices positioned for use as a hemi-walker can further be combined with a support strut, the combination creating a collapsible four-legged walker. Additionally, the one or more legs of the device can be adjusted to have different heights. Further, by adjusting one leg to a different height than the other leg, the device can be used as a stair-climbing aide. Finally, the device can be used to assist in supporting the transition between sitting and standing by utilizing specially located grips on the device.

These functions are accomplished by a single device that can be converted in seconds or with simple attachments. A unique articulation assembly allows the legs to be moved through an infinite number of positions, from a cane-like design, to the width of a typical four-legged walker, or any other desired width.

FIG. 1 depicts an embodiment of a multi-configuration walking apparatus 10. The walking apparatus 10 comprises a first leg section 12 and a second leg section 14. The leg sections 12, 14 depicted in FIG. 1 extend, generally vertically, from the bottom of the walking apparatus 10 to the top of the walking apparatus 10. As further shown in FIG. 1, the first and second leg sections 12, 14 of some embodiments are symmetric, however, other embodiments include asymmetric leg sections.

A leg section 12, 14 can be made of a wide range of materials, shapes, and sizes. In some embodiments, a leg section 12, 14 is made of metal, wood, plastic, or composites. Further, some embodiments of a leg section 12, 14 are made of tubing or material formed in other shapes. Preferred embodiments of leg sections 12, 14 are made of metal tubing. While a walking apparatus can comprise a wide variety of materials, sizes, and shapes, the design of leg sections 12, 14 of walking apparatus 10 should reflect the needs and desires of the targeted user. These needs include walking apparatus strength, durability, and weight. A person skilled in the art will recognize that a wide variety of materials and shapes may be used in the design of leg sections 12, 14 and that the present disclosure does not limit leg sections 12, 14 to certain materials or shapes.

In some embodiments, the first and second leg sections 12, 14 include upper legs. More specifically, in some embodiments the first and second leg sections 12, 14 include first and second upper offset legs 16, 18. An embodiment of upper offset legs 16, 18, as depicted in FIG. 1, comprise partially vertically extending portions and first and second handgrip sections 20, 22, the handgrip sections 20, 22 extending laterally away from the vertical portions of the leg sections 12, 14. A person skilled in the art will recognize that this disclosure is not limited to the specific direction of extension of the handgrip sections 20, 22 shown in FIG. 1, but that numerous directions of extension of the handgrip sections 20, 22 fall within the realm of this disclosure. A person skilled in the art will further recognize that a multi-configuration walking apparatus is not limited to embodiments containing a handgrip section or upper offset leg as depicted in FIG. 1.

Similar to the first and second leg sections 12, 14, the upper offset legs 16, 18 can be made from a variety of materials in a variety of shapes. This may include the same materials and shapes as the other portions of the leg sections 12, 14, however, the upper offset legs may be made of materials other than those used in other portions of the leg sections 12, 14. Additionally, different areas of the upper offset legs 16, 18 can comprise different materials and shapes.

As depicted in FIG. 1, embodiments of the walking apparatus 10 may include joined first and second leg sections 12, 14. In the embodiment depicted in FIG. 1, the first and second leg sections 12, 14 are joined at the first and second upper offset legs 16, 18. The connecting of the first and second leg sections 12, 14 can be accomplished through the use of a variety of linkages, and, at a variety of locations. In preferred embodiments, and as shown in FIG. 1, the first and second leg sections 12, 14 are joined at the end of the first and second handgrip sections 20, 22, and, with a connecting mechanism 24. In the embodiment depicted in FIG. 1, the connecting mechanism 24 comprises struts 26. Struts 26 enable the reconfiguration of the walking apparatus 10 by allowing the repositioning of the leg sections 12, 14 relative to each other. Additionally, struts 26 increase the stability of the walking apparatus 10 and increase its ability to resist torque and twisting. In the embodiment depicted in FIG. 1, the walking apparatus 10 employs three struts 26. However, a person skilled in the art will recognize that any number of struts 26 may be used in joining the first and second handgrip sections 20, 22, and that features other than struts may be used to join the first and second leg sections 12, 14. A person skilled in the art will also recognize that the present description is not limited to embodiments in which the handgrip sections 20, 22 are joined, but includes embodiments in which the linkage between the first and second leg sections 12, 14 is at a location apart from the handgrip sections 20, 22.

The first and second leg sections 12, 14 also include lower leg sections 30, 32. In preferred embodiments, the lower leg sections 30, 32 are adjustably connected to the first and second upper offset legs 16, 18. In one embodiment, the first and second lower leg sections 30, 32 are connected to the upper offset legs 16, 18 so as to be infinitely adjustable. In another embodiment, the first and second lower leg sections 30, 32 are connected to the upper offset legs 16, 18 having a finite number of adjustment positions. In one embodiment of a walking apparatus 10, the first and second lower leg sections 30, 32 are connected to the first and second upper offset legs 16, 18 with clamps. In another embodiment of a walking apparatus 10, the first and second lower leg sections 30, 32 are connected the first and second upper offset legs 16, 18 with locks and pressure rings. A person skilled in the art will recognize that a variety of mechanisms can be utilized to adjustably connect the lower leg sections 30, 32 to the upper offset legs 16, 18, and that some embodiments of a walking apparatus will not include adjustable lower leg sections 30, 32.

Similar to other portions of the leg sections 12, 14, the lower leg sections 30, 32 can be made of a variety of materials in a variety of shapes. In preferred embodiments, the lower leg sections 30, 32 are made of aluminum tubing having an outside diameter which is smaller than the inside diameter of the upper offset legs 16, 18, thus allowing the lower leg sections 30, 32 to slide into the upper offset legs 16, 18. Additionally, as depicted in FIG. 1, preferred embodiments of a walking apparatus include base pieces 34 located at the bottom of the first and second lower leg sections 30, 32. The base pieces 34 of preferred embodiments are configured to contact the ground, avoid slippage relative to the ground, and to absorb shock.

A multi-configuration walking apparatus 10 is adjustable to a variety of configurations. FIG. 1 depicts the walking apparatus 10 in a cane-like configuration in which the leg sections 12, 14 are positioned so that the base pieces 34 of the first and second leg sections 12, 14 are in close proximity. This configuration has a small footprint, as the base pieces 34 are in close proximity, which increases maneuverability. This small footprint further eases use of the walking apparatus on uneven ground as a suitable location for a small area of ground contact is more easily locatable than a large area. Additionally, this configuration facilitates use of one or two hands with the walking apparatus. Thus, a person desiring less support can hold onto the walking apparatus 10 with one hand, while a person desiring more support can hold onto the walking apparatus 10 with two hands.

Methods of use of a walking device include configuration of the device by a variety of people. In some embodiments, the steps of adjusting the height of the first or second leg sections and adjusting the relative positions of the first and second leg sections, so as to change the footprint size, can be performed by the end user. In other embodiments, the steps of adjusting the height of the first or second leg sections and adjusting the relative positions of the first and second leg sections, so as to change the footprint size, can be performed by a person other than the end user.

Some embodiments of a walking apparatus 10 further include grips 36. The grips 36 aid the user in holding on to the walking apparatus 10, and aid the user in using the walking apparatus 10 as an aid to other movements, including, standing or sitting. These grips 36 can be located in multiple locations on the walking apparatus. In one embodiment, as shown in FIG. 1, grips 36 are located on the handgrip sections 20, 22. FIG. 1 further shows a grip 36 located on the second upper offset leg 18. A person skilled in the art will recognize that the location of grips 36 is not limited to those locations depicted in FIG. 1, but that grips 36 can be located at any position on the walking apparatus 10, including, on the leg sections 12, 14 and struts 26.

Figure 2:
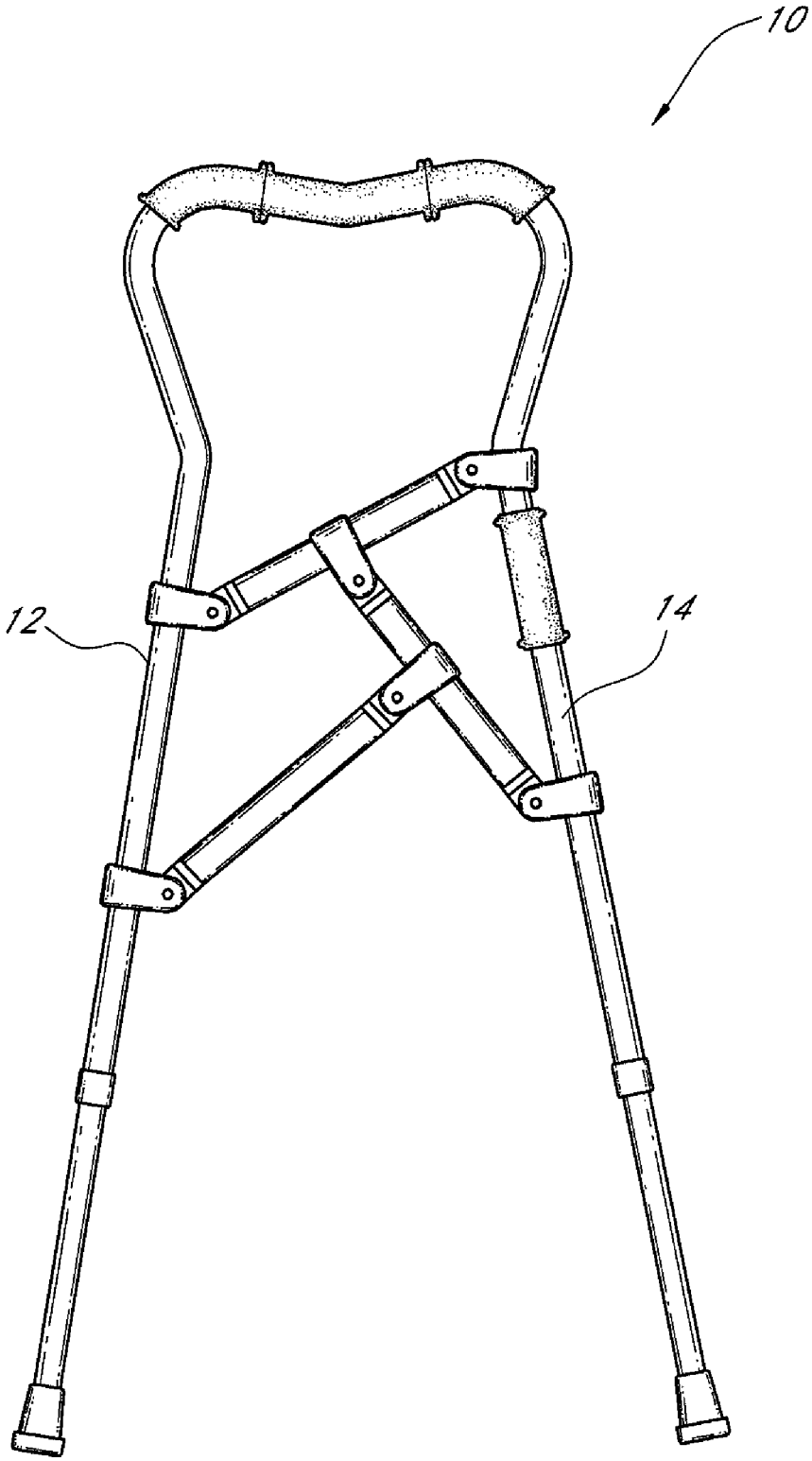
FIG. 2 is a side view of a multi-configuration walking apparatus in an expanded position.

FIG. 2 depicts a side view of a multi-configuration walking apparatus 10 in an expanded position. The figure illustrates a configuration that is similar in characteristics to a walker. In an expanded configuration as depicted in FIG. 2, both leg sections 12, 14 are spread to a distance of approximately twenty-four inches. In other embodiments the distance the leg sections 12, 14 are spread apart is equal to the width of the user's shoulders or to approximately thirty inches. Widening the stance to the larger footprint sized configuration provides a configuration with two distinct and separate ground contacts, and also provides, with this larger footprint, increased lateral stability for a user. In another mode of the invention, the walking apparatus 10 may be configured to a mid-wide stance. In a mid-wide stance the walking apparatus 10 may be employed as a side-by-side hemi-walker. Side-by-side hemi-walkers are particularly useful for use by individuals with one sided weakness such as those having had a stroke or persons with walking or other lateral balance disabilities.

Figure 3:
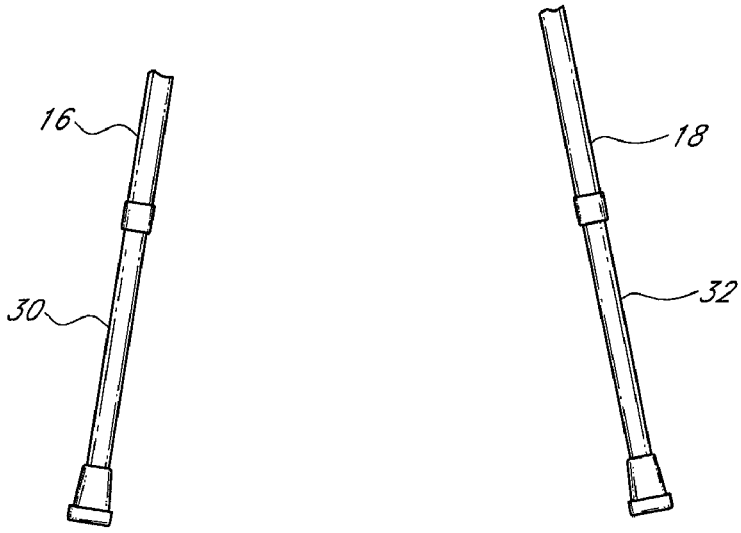
FIG. 3 is a side view of a leg section of a multi-configuration walking apparatus in an expanded position.

FIG. 3 depicts a side view of first and second lower leg sections 30, 32 of a multi-configuration walking apparatus in an expanded position. As discussed, the lower leg sections 30, 32 of some embodiments of the walking apparatus 10 are adjustably connected to the first and second upper offset legs 16, 18. The adjustability of the lower leg sections 30, 32 provides several advantages, including the ability to adjust the walking apparatus 10 to smoothly traverse uneven ground, and to be adaptable to different user heights. Further, lower leg sections 30, 32 are sized generally to accommodate use by persons of various sizes and may be made from any material or combinations of materials that are capable of supporting the applied weight of a person during use in sitting, rising and walking.

Figure 4:
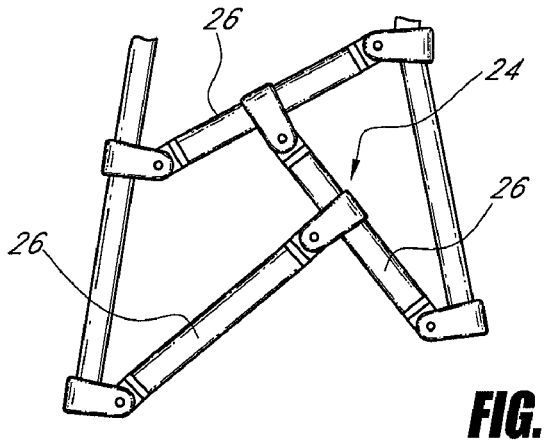
FIG. 4 is a side view of a connecting mechanism section of a multi-configuration walking apparatus in an expanded position.

FIG. 4 depicts a side view of a connecting mechanism 24 of a multi-configuration walking apparatus 10 in an expanded position. In some embodiments, the connecting mechanism 24 comprises a configuration of at least one strut 26. In one embodiment the at least one strut 26 is attached to the upper offset legs. FIG. 4 depicts a preferred embodiment of the connecting mechanism 24 comprising three struts 26. A person skilled in the arts will recognize that the embodiment depicted in FIG. 4 does not limit the scope of the present disclosure to embodiments comprising three struts, but that embodiments comprising more or fewer struts are likewise within the scope of this disclosure. In some embodiments, for example, a connecting mechanism may comprise four struts so as better resist torque and twisting in the walking device. In other embodiments, where weight is a greater concern, the connecting mechanism may only comprise one or two struts.

Struts 26 are connected to each other and to the first and second upper offset legs, and thus enable compound articulation of the connecting mechanism 24. The connecting mechanism 24 allows the walking apparatus 10 to be widened or narrowed to a variety of configurations. In one embodiment of a walking apparatus, the base pieces of the first and second leg sections 12, 14 can be approximately separated by zero to twenty-four inches. A person skilled in the art will recognize that the present disclosure does not limit the range of separation to that disclosed in the specific embodiment.

A connecting mechanism 24 further comprises locking features. In some embodiments of a connecting mechanism 24, these features can include pins, bolts, screws, or other fasteners. Additionally, in some embodiments, permanent locking features may be used in connection with the connecting mechanism 24, including, adhesives, welding, crimping, or clamping.

Figure 5:
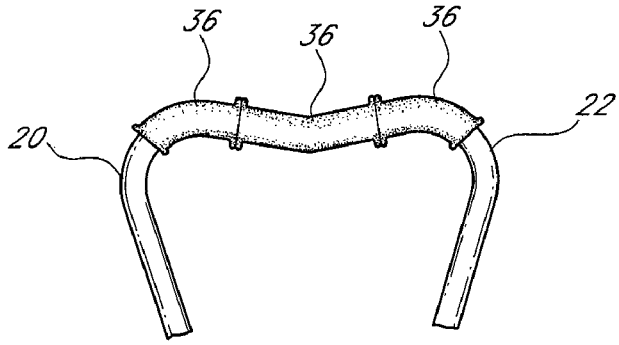
FIG. 5 is a side view of a handgrip section of a multi-configuration walking apparatus in an expanded position.

FIG. 5 is a side view of handgrip sections 20, 22 of a multi-configuration walking apparatus 10 in an expanded position. The embodiment of the handgrip section 20, 22 also include grips 36. The grips 36 comprise a separate material to facilitate a comfortable grip on the apparatus. The grips 36 may be padded or firm. In one example the grips 36 are made from a foam or sponge like material. In another embodiment, materials such as plastic, vinyl, neoprene, rubber and other materials or the like, or a combination of hard and soft materials may be used to facilitate a secure grip or a cushioned grip.

Figure 6:
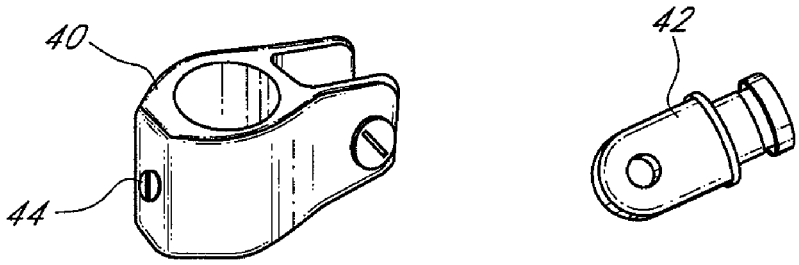
FIG. 6 is a perspective view of a slide and eye end used in a multi-configuration walking apparatus.

FIG. 6 illustrates a perspective view of slide 40 and eye end 42 used in some embodiments of a multi-configuration walking apparatus 10. A variety of slides can be used in a walking apparatus. In preferred embodiments include jaw slides. Slide 40 contains a locking feature 44. In the embodiment shown in FIG. 6, locking feature 44 comprises a screw. In other embodiments, locking feature 44 can comprise clamps, snaps, detent pins, or any other feature capable of fixing the position of a slide 40. Although FIG. 6 depicts a particular configuration and placement of slides 40 and eye ends 42, the present disclosure includes a variety of configurations and placements of slides 40 and eye ends 42.

In one embodiment the slide 40 and eye end 42 are manufactured from nylon material. Alternately, other materials may be used such as plastic, metal or the like. FIG. 6 additionally depicts eye ends 42 as separable from struts. However, in some embodiments, eye ends 42 may be integrally formed with struts.

Figure 7:
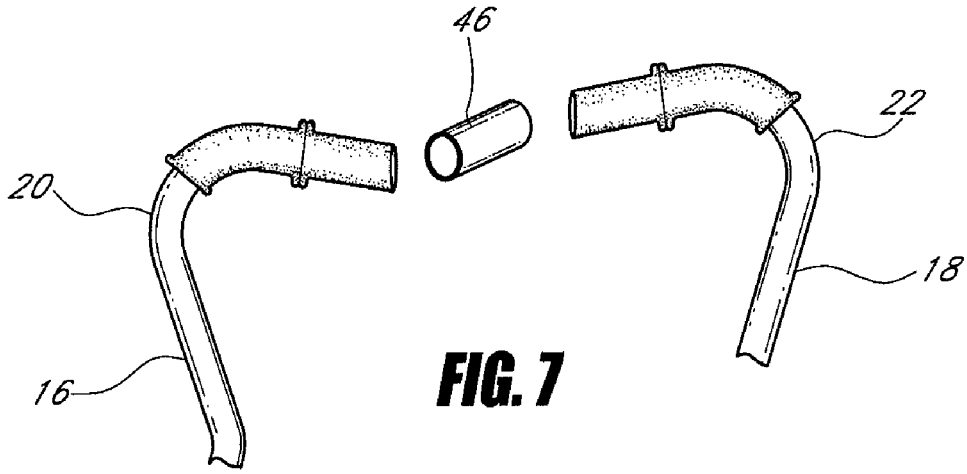
FIG. 7 is a perspective exploded view of a handgrip section of a multi-configuration walking apparatus.

FIG. 7 depicts a perspective exploded view of handgrip sections 20, 22 of a multi-configuration walking apparatus. Two upper offset legs 16, 18 are joined together by a joint 46. In some embodiments of the walking apparatus, the joint 46 is a flexible joint. In other embodiments of a walking apparatus, the joint 46 is a non-flexible connector. When attached by a flexible or non-flexible connector, the first and second leg sections create a major weight bearing structure that simultaneously allows the walking apparatus to flex and accommodate the expansion and contraction of the two leg sections.

Figure 8:
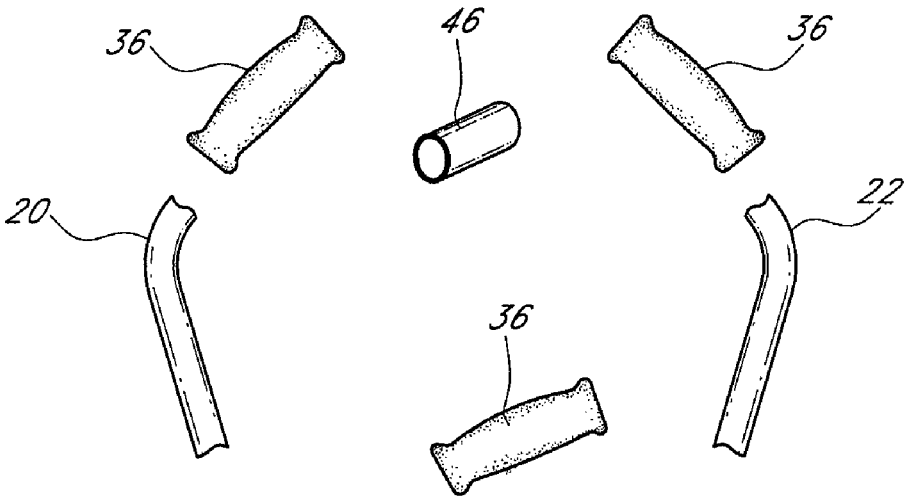
FIG. 8 is a perspective exploded view of a handgrip section of a multi-configuration walking apparatus.

FIG. 8 shows a perspective exploded view of handgrip sections 20, 22 of a multi-configuration walking apparatus. Specifically, FIG. 8 illustrates one method of assembling handgrip sections 20, 22. Joint 46 may comprise a variety of materials, including, neoprene, silicone, or other flexible materials. Alternately the joint 46 may comprise material such as, wood, metal, plastic, or other non-flexible materials. In one embodiment the leg sections and the joint 46 are connected by screws, bolts, pins, rivets, or other similar fasteners. Alternately other connection methods may be used to connect the leg sections to the joint insert 46, including welds, glue, epoxy and other similar methods.

Figure 9:
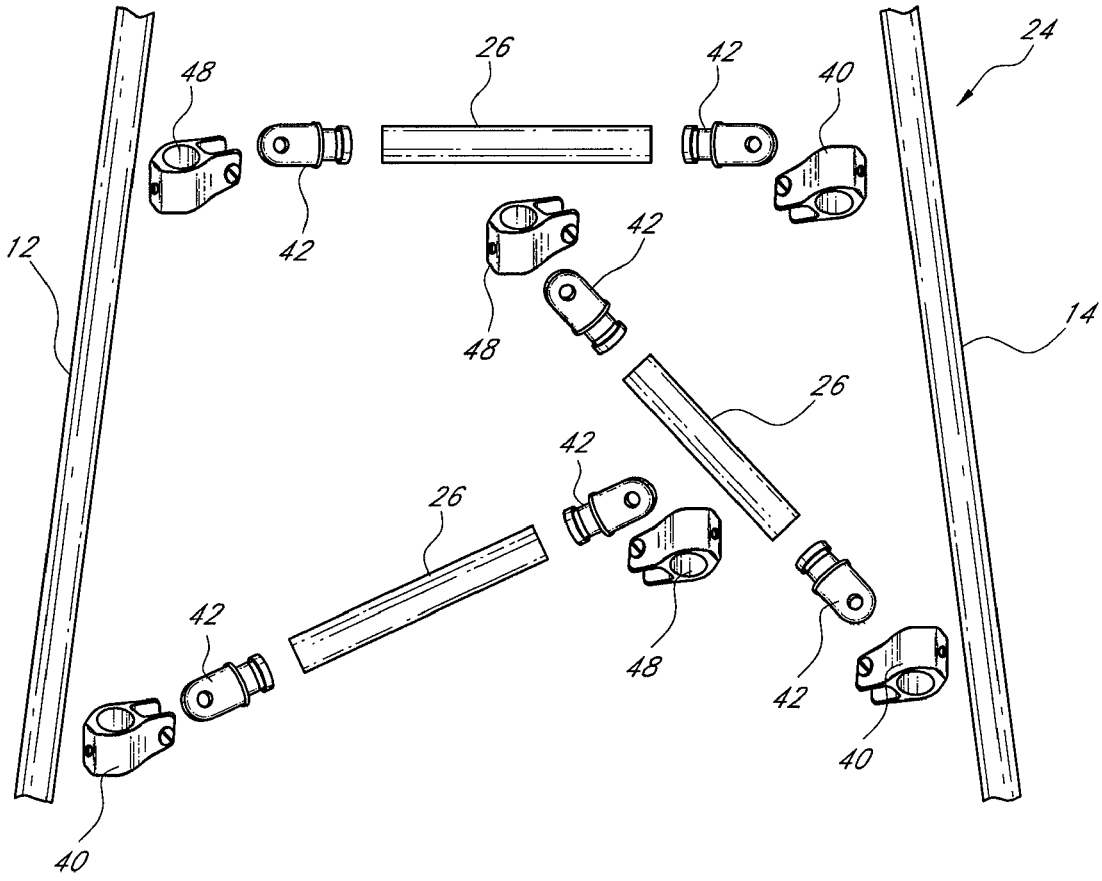
FIG. 9 is a perspective exploded view of a connecting mechanism section of a multi-configuration walking apparatus.

Referring to FIG. 9, a perspective exploded view of one embodiment of a connecting mechanism 24 of a multi-configuration walking apparatus. The connecting mechanism 24 comprises three struts 26. The length of struts 26 can be selected to provide the desired range of expansion of the leg sections 12, 14. The functionality of the connecting mechanism 24 can be further altered by varying the type of attachment and the attachment locations of the struts 26 to each other and to leg sections 12, 14. In the embodiment depicted in FIG. 9, the walking apparatus uses six slides 40 and six eye ends 42 to connect the three struts 26 and the leg sections 12, 14. As depicted in FIG. 9, eye ends 42 are affixed to the ends of struts 26. Eye ends 42 are additionally pinned to slides 40. The pinning connection of the eye ends 42 to the slides 40 creates and bendable joint. Slides 40 are further connected to portions of leg sections 12, 14 and portions of struts 26, creating a joint slidable along the axis of the member to which the slide 40 is connected. The combination of slides 40 and eye ends 42 allows sliding and bending motion within the connecting mechanism 24, thus creating an apparatus capable of multi-configuration. In some embodiments of a connecting mechanism 24, all of the slides 40 are slidably connected to either a leg section or to a strut. In other embodiments of a connecting mechanism 24, some of the slides 40 are fixedly connected to either a leg section or to a strut. In one preferred embodiment, three fixed slides 48 fixedly connected to either a leg section or to a strut. A person skilled in the art will recognize that a connecting mechanism 24 is not limited to the specific embodiment disclosed containing three struts 26, six slides 40, and six eye ends 42, but rather discloses a broad range of connecting mechanisms comprising a variety of components useful to create a stable and articulable walking apparatus 10.

Thus, other embodiments may include more or less struts 26, slides 40, and eye ends 42. Other embodiments may also rely on different connecting means than those specifically disclosed.

Figure 10A:
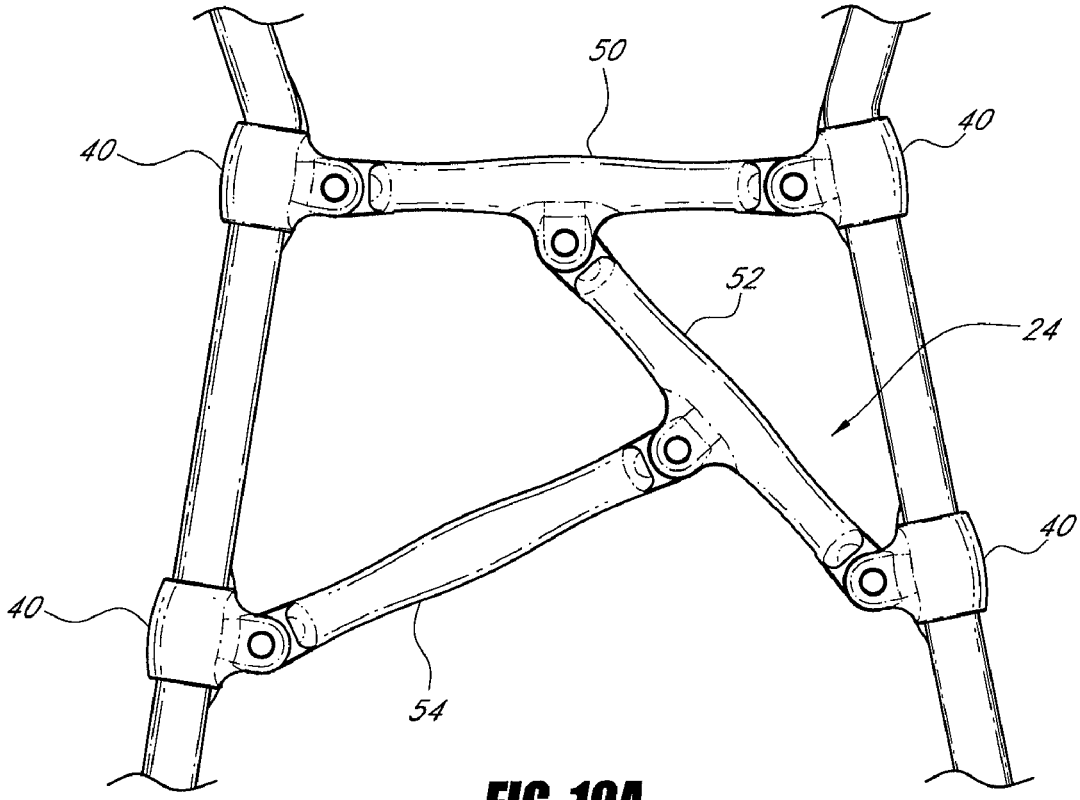
FIG. 10*a* is a side view of a connecting mechanism.

FIG. 10*a* depicts another embodiment of a connecting mechanism 24 comprising a first three-eye strut 50, a second three-eye strut 52, and a two-eye strut 54. In contrast to above embodiment, struts 50, 52, 54 comprise integrally connected eyes configured for connection with slides 40.

Figure 10B:
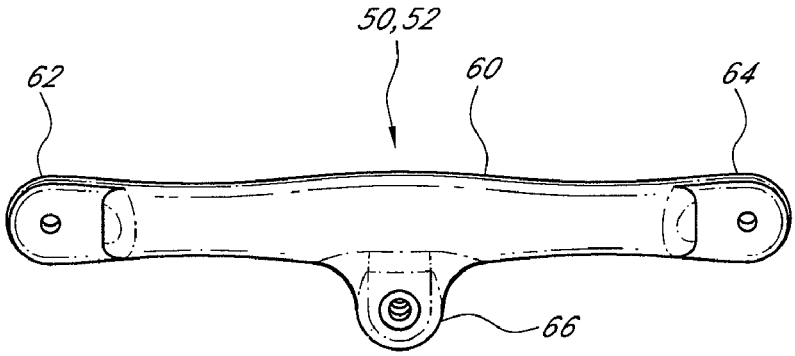
FIG. 10*b* is a perspective view of a three-eye strut.

FIG. 10*b* is a perspective view of a three-eye strut 50, 52. The three-eye strut comprises central member 60, a first eye and a second eye 62, 64 located at opposite ends of the central member 60, and a third eye 66 located on the central member 60 at a location apart from the opposite ends of the central member 60.

Figure 10C:
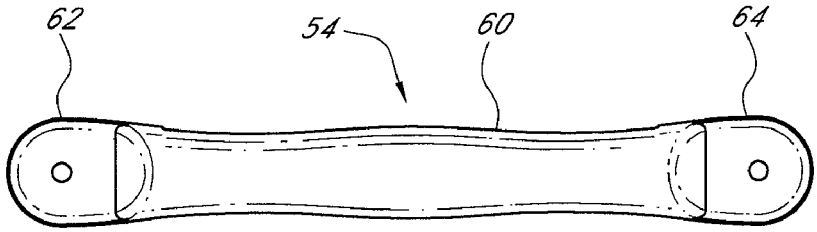
FIG. 10*c* is a perspective view of a two-eye strut.

FIG. 10*c* is a perspective view of a two-eye strut 54. A two-eye strut comprises a central member 60 and first and second eyes 62, 64 located at opposite ends of the central member 60.

In preferred embodiments, struts 50, 52, 54 and eyes comprise unitary members created by molding, stamping, or forming through other manufacturing methods. Additionally, these struts 50, 52, 54 and eyes can comprise metal, plastic, composites, or other materials.

Figure 11:
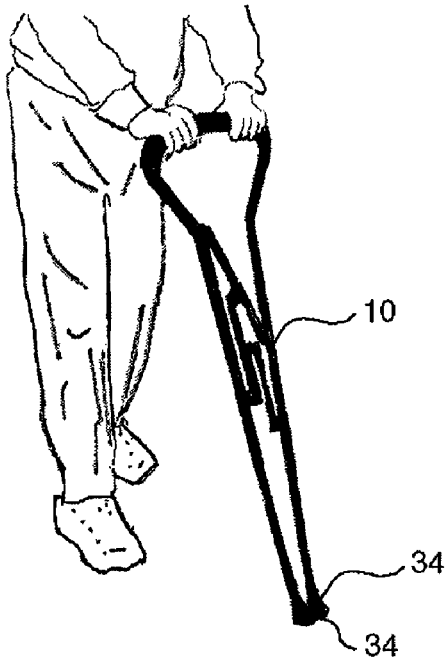
FIG. 11 is a front view of a multi-configuration walking apparatus in a closed position, to form a one-legged, two-handed walker.

FIG. 11 depicts a multi-configuration walking apparatus 10 in a closed configuration and a method of using the walking apparatus 10 in that configuration. As depicted, the walking apparatus 10 of this configuration creates a small point of ground contact due to the proximity of base pieces 34. As further depicted, a walking apparatus 10 in this configuration can be used as a one-legged, two-handed walker.

Figure 12:
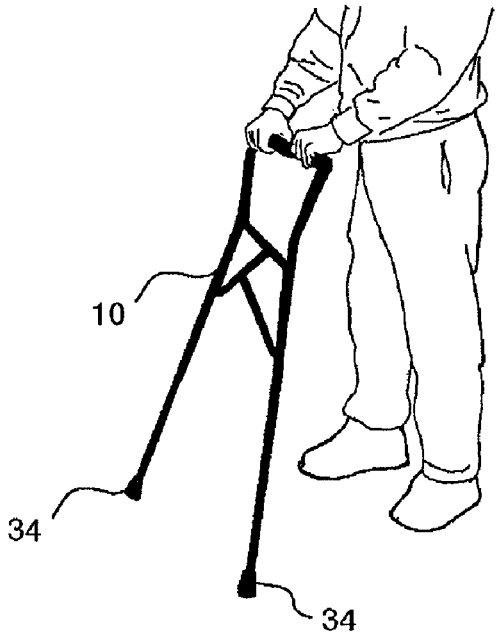
FIG. 12 is a front view of a multi-configuration walking apparatus in an open position, to form a two-legged, two-handed walker.

FIG. 12 depicts a multi-configuration walking apparatus 10 in an open position, and a method of use of that walking apparatus 10. Due to the greater separation of base pieces 34, the walking apparatus 10 provides greater lateral stability to the user, and may be used as a two-legged, two-handed walker.

Figure 13:
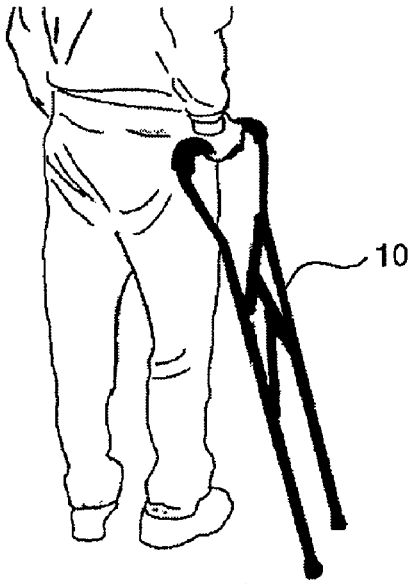
FIG. 13 is a perspective view of a multi-configuration walking apparatus in a mid-wide stance for use as a side-by-side hemi-walker.

FIG. 13 depicts a mid-wide stance of a multi-configuration walking apparatus 10, and a method of using this configuration. As depicted, one embodiment of a method of using a walking apparatus 10 in a mid-wide stance includes use as a side-by-side hemi-walker. A person skilled in the art will recognize that use as a hemi-walker includes use of one or more walking apparatuses.

Figure 14:
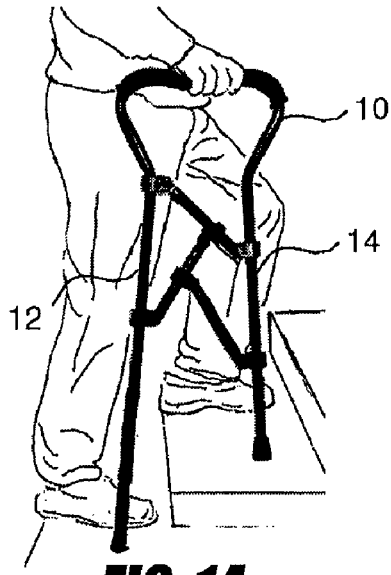
FIG. 14 is a side view of a multi-configuration walking apparatus having the height of one leg adjusted to configure the apparatus into a stair-climbing aide.

FIG. 14 depicts a multi-configuration walking apparatus 10 configured for use in stair ascension and descension. In this configuration, the leg sections 12, 14 are disparately adjusted such that the vertical position of the first and second leg sections 12, 14 inversely replicates the vertical position of the step upon which the leg section will be placed.

Figure 15:
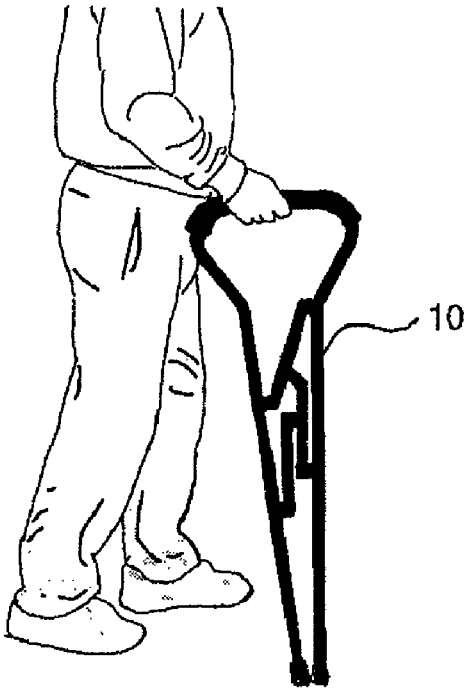
FIG. 15 is a side view of a multi-configuration walking apparatus in a closed position, to form a bariatric cane.

FIG. 15 depicts a method of use of a multi-configuration walking apparatus 10 in a closed configuration. In this embodiment, the walking apparatus 10 is used as a bariatric cane.

Figure 16:
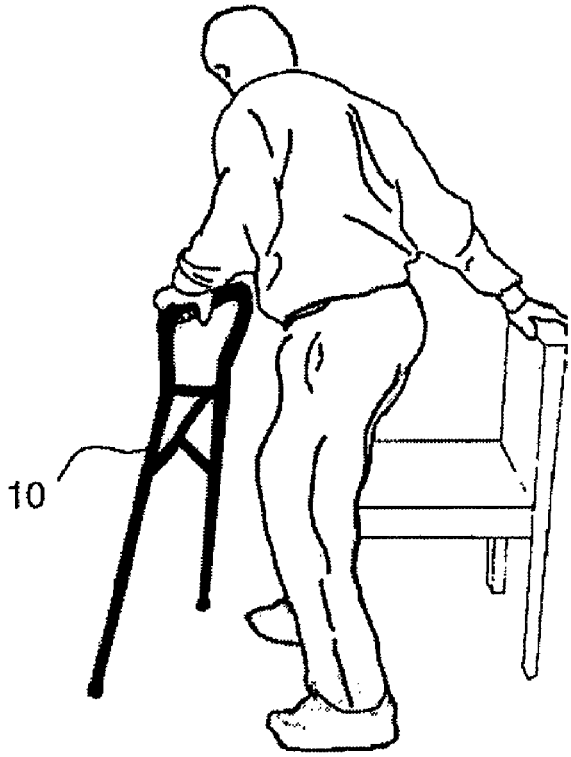
FIG. 16 is a perspective view of a multi-configuration walking apparatus in a mid-wide stance for use to provide assistance to a user by supporting the transition from the sitting to standing state.

FIG. 16 depicts a further method of use of a multi-configuration walking apparatus 10 configured in a mid-wide stance. In this embodiment, the walking apparatus 10 provides support for the user in transitioning from one position to another, specifically, between standing and sitting positions. A person skilled in the art will recognize, however, that this embodiment is not limited to use in transition between sitting and standing positions but covers transitions between all positions.

Multiple uses of the invention are envisioned by the inventor. The height of the apparatus is adjustable to accommodate the proper height for a large array of users. A user may select preferred positions of the legs relative to each other. Selection of the position is determined by the specific needs of the user. For example in the closed position, the apparatus is a one-legged, two-handed walker, for use on uneven terrain and more momentum. By widening the stance of the apparatus is configured to be a two-legged, two-handed walker, allowing for increased lateral stability for a user. In a mid-wide stance the apparatus may be used as a side-by-side hemi-walker. Furthermore, a simple height adjustment of one leg transforms the apparatus into a stair-climbing aide. In a closed position the walking apparatus is configured to be a bariatric cane, allowing for support of heavier users. Additionally, each of the above described configurations may be used with one or two hands depending on the user's needs and abilities. Further embodiments of use also include the use of multiple walking apparatuses 10 in combination. In such embodiments, the walking apparatuses 10 may be connected or held independently, each by one hand.

Other embodiments consist of attaching a pouch or multi-pocket accessory to carry personal items. Additionally, another embodiment of a walking apparatus may be used in a variety of applications such as a support frame for a temporary structure such as a canopy or tent. A smaller version of the device could be used as a support for a golf bag or as a bench rest or otherwise stable support for a rifle or pistol. The collapsible nature of the device and its adjustability make it ideal where its transporting, accommodating to terrain, and load-bearing capabilities vastly expand its utility as the above examples demonstrate. Two or more such devices could be joined together to provide a multi-legged structure with adjustable height and width. A single or multi-unit variation could be used to support a camera, telescope, or table. In a much larger iteration, the multi-legged structure is a fully adjustable, load-bearing tower for power lines.

While the invention has been described in connection with a number of embodiments, it is not intended to limit the scope of the invention to the particular forms set forth, but on the contrary, it is intended to cover such alternatives, modifications, and equivalents as may be included within the scope of the invention.

The invention claimed is:

1. A walking assistance device, comprising:

a first leg, having a vertical portion with a bottom and a top, and a horizontal portion, wherein the horizontal portion has a first end distant from the vertical portion;

a second leg, having a vertical portion with a bottom and a top, and a horizontal portion, wherein the horizontal portion has a first end distant from the vertical portion;

wherein the first ends of the horizontal portions of the first and second legs extend towards each other;

a flexible joint connecting the first ends of the horizontal portions of the first and second legs, the first ends of the horizontal portions of the first and second legs and the flexible joint forming a handle portion and comprising a length;

a connecting mechanism below the flexible joint extending from the vertical portion of the first leg to the vertical portion of the second leg;

wherein the bottom ends of the vertical portions of the first and second legs are spaced apart by an adjustable distance, wherein the adjustable distance includes a first position and a second position, and the bottom ends of the first and second legs can be locked into said first and second positions, where the distance between the bottom ends of the first and second legs in the second position is more that twice the distance between said bottom ends in the first position, wherein the walking assistance device can be reconfigured from the first position to the second position by changing the relative angular positioning of the first leg and the second leg within a plane defined by the vertical portions of the first and second legs in the first position, wherein the length of the handle portion remains substantially unchanged between the first and second positions, wherein the connecting mechanism connects the vertical portion of the first leg with the vertical portion of the second leg in both the first and second positions, and wherein the device has exactly two ground contact points, consisting of the bottom ends of the first and second legs.

2. The device of claim 1, wherein the first leg and the second leg each have a height, and wherein the height of the first leg is adjustable independently of the height of the second leg, such that one said leg can be adjusted to allow traverse of uneven ground while maintaining the horizontal portions of the first and second legs in a substantially horizontal position.

3. The device of claim 1, further including an adjustment mechanism linking the first leg and the second leg, wherein the adjustment mechanism permits infinitely-variable distance adjustment between the bottom ends of the first and second legs, wherein the adjustment mechanism further includes a locking structure to securely lock the relative positions of the first and second legs.

4. The device of claim 3, wherein the adjustment mechanism further comprises at least one strut adjustably linking the first leg and the second leg.

5. A method for using a walking assistance device, comprising:

providing a walking assistance device as set forth in claim 1;

reducing the height of the first leg prior to using the device for ascending a set of stairs;

reducing the height of the second leg prior to using the device for descending a set of stairs; and adjusting the distance between the bottom ends of the first and second legs from a relatively wide spacing to a relatively narrow spacing.

6. A method for using a walking assistance device as recited in claim 5, further comprising grasping the walking apparatus with one hand.

7. A method for using a walking assistance device as recited in claim 5, further comprising grasping the walking apparatus with two hands.

8. A method for using a walking assistance device, comprising:

providing a walking assistance device as set forth in claim 1; and progressively reconfiguring the device to match the immediate walking assistance needs of the user by adjusting the distance between the bottom ends of the first and second legs between a relatively wide spacing and a relatively narrow spacing.

9. A method for using a walking assistance device as recited in claim 8, further comprising:

grasping the device with one hand when a lesser degree of support is desired; and grasping the device with two hands when a greater degree of support is desired.

10. A walking assist apparatus, comprising:

a first leg having a top and a bottom and being adjustable in height;

a second leg having a top and a bottom;

first and second handle sections respectively located at the top of the first and second legs, the handle sections extending from the top of their respective leg toward each other, and being joined together in a flexible joint, the first and second handle sections and the flexible joint forming a handle portion comprising a length;

a first brace extending between the first and second legs, being vertically adjustable with respect to the first leg;

a second brace extending from the second leg to an intermediate portion of the first brace; and a third brace having a first end connected to the first leg and a second end connected to the second brace;

wherein the first, second, and third braces are adjustable with respect to each other and with respect to the first and second legs to permit selectable adjustment of a relative distance between the bottoms of the first and second legs, wherein the walking assistance device can be reconfigured from the first position to the second position by changing the relative angular positioning of the first leg and the second leg within a plane defined by the vertical portions of the first and second legs in the first position, wherein the length of the handle portion remains substantially unchanged between the first and second positions; and a locking mechanism to lock the first and second legs at a desired relative distance following said adjustment.

* * * * *